US011596288B2

(12) United States Patent
Kullwitz et al.

(10) Patent No.: US 11,596,288 B2
(45) Date of Patent: Mar. 7, 2023

(54) SYSTEM FOR DETERMINING AN OPERATING STATE OF A DISHWASHER AND AN ACCORDING METHOD

(71) Applicant: Ecolab USA Inc., St. Paul, MN (US)

(72) Inventors: Dirk Kullwitz, Toenisvorst (DE); Jeremy Nowak, Korschenbroich (DE); Freek Schepers, Duesseldorf (DE)

(73) Assignee: Ecolab USA Inc., Saint Paul, MN (US)

( * ) Notice: Subject to any disclaimer, the term of this patent is extended or adjusted under 35 U.S.C. 154(b) by 386 days.

(21) Appl. No.: 15/607,024

(22) Filed: May 26, 2017

(65) Prior Publication Data

US 2017/0325650 A1 Nov. 16, 2017

Related U.S. Application Data

(63) Continuation of application No. 14/413,118, filed as application No. PCT/EP2012/063269 on Jul. 6, 2012, now Pat. No. 9,661,977.

(51) Int. Cl.

| | |
|---|---|
| ***A47L 15/00*** | (2006.01) |
| ***A47L 15/44*** | (2006.01) |
| ***A47L 15/46*** | (2006.01) |

(52) U.S. Cl.

CPC ..... *A47L 15/0055* (2013.01); *A47L 15/449* (2013.01); *A47L 15/46* (2013.01);
(Continued)

(58) Field of Classification Search

CPC .... A47L 15/0055; A47L 15/449; A47L 15/46; A47L 2401/023; A47L 2401/12; A47L 2401/30; A47L 2401/34; A47L 2501/36
(Continued)

(56) References Cited

U.S. PATENT DOCUMENTS

| | | | |
|---|---|---|---|
| 4,509,543 | A | 4/1985 | Livingston et al. |
| 5,207,080 | A | 5/1993 | Reinhard |

(Continued)

FOREIGN PATENT DOCUMENTS

| | | | |
|---|---|---|---|
| DE | 102006038341 | A1 | 2/2008 |
| DE | 102010028612 | A1 | 11/2011 |

(Continued)

OTHER PUBLICATIONS

Kessler et al., "DE102006038341A1 English Machine Translation. pdf", Feb. 21, 2008—Machine translation from Espacenet.com.

(Continued)

*Primary Examiner* — Levon J Shahinian
(74) *Attorney, Agent, or Firm* — Fredrikson & Byron, P.A.

(57) ABSTRACT

A washing system for determining an operating state of a dishwasher comprises a dishwasher, in particular wherein the dishwasher comprises a dishwasher interface, a dispenser unit, in particular wherein the dispenser unit comprises a dispenser interface, wherein the dispenser unit is connected to the dishwasher for dosing a detergent to the dishwasher, a logic unit, in particular wherein the logic unit is connectable to the dishwasher interface and the dispenser interface, and a current sensor for measuring an electrical current consumed by the dishwasher, wherein the current sensor is connected to the logic unit. By replacing costly water meters by a current sensor, the cost efficiency of the washing system may be increased. In addition, the assembling and maintenance effort of the washing system may be reduced.

13 Claims, 2 Drawing Sheets

(52) U.S. Cl.
CPC ..... *A47L 2401/023* (2013.01); *A47L 2401/12* (2013.01); *A47L 2401/30* (2013.01); *A47L 2401/34* (2013.01); *A47L 2501/36* (2013.01)

(58) Field of Classification Search
USPC ..... 134/56 D, 57 D, 58 D, 113
See application file for complete search history.

(56) References Cited

U.S. PATENT DOCUMENTS

| | | | | |
|---|---|---|---|---|
| 5,603,233 | A | 2/1997 | Erickson et al. | |
| 2010/0212692 | A1 | 8/2010 | Sundaram | |
| 2012/0222712 | A1 * | 9/2012 | Bastigkeit ..... | A47L 15/006 134/57 D |
| 2012/0048302 | A1 | 10/2012 | Didat | |

FOREIGN PATENT DOCUMENTS

| | | | | |
|---|---|---|---|---|
| WO | 2010007054 | A1 | 1/2010 | |
| WO | WO-2011039304 | A1 * | 4/2011 | ..... A47L 15/006 |
| WO | 2011051178 | A1 | 5/2011 | |

OTHER PUBLICATIONS

English Machine Translation of Abstract for DE102006038341, published Feb. 21, 2008, 3 pages.
English Machine Translation of Abstract for DE102010028612, published Nov. 10, 2011, 2 pages.
International Search Report for International Application No. PCT/EP2012/063269, dated Apr. 4, 2013, 4 pages.

* cited by examiner

| | Consumption of electricity | Defaut Signals | | | | | Dispenser | Operating state |
|---|---|---|---|---|---|---|---|---|
| | | Temperature | | Dosing-signal | | Machine-signal | Dosing-signal | |
| | | Wash | Rinse | Wash | Rinse | | | |
| 1 | + | Ok | Ok | 0 | 0 | 1 | 0 | High stand-by |
| 2 | 0 | Ok | Ok | 1 | 1 | 1 | 1 | Normal operation |
| 3 | + | - | Ok | 0 | 0 | 1 | 1 | Leaking tank |
| 4 | - | Ok | Ok | 1 | 1 | 1 | 0 | Water volume too low |
| 5 | + | + | + | 1 | 1 | 1 | 1 | Temperature too high |

Fig. 3

SYSTEM FOR DETERMINING AN OPERATING STATE OF A DISHWASHER AND AN ACCORDING METHOD

CROSS REFERENCE TO RELATED APPLICATION

This application is a continuation of U.S. patent application Ser. No. 14/413,118, filed Jun. 16, 2015. U.S. patent application Ser. No. 14/413,118 is a national stage application of International Application No. PCT/EP2012/063269, filed Jul. 6, 2012, published as PCT Publication WO 2014/005650 A1, the entire contents of these applications are incorporated herein by reference in their entirety.

TECHNICAL FIELD OF THE INVENTION

The present invention relates to a system for determining an operating state of a dishwasher and a method of determining an operating state of a dishwasher.

BACKGROUND OF THE INVENTION

A washing system, in particular comprising a dishwasher, may usually disperse more than one type of washing solution, a detergent for example, to a washing zone of the washing system. In order to increase the effectiveness of the used washing solution, washing systems may be monitored and controlled for example by a data management system, which acquires information of the washing system, like the water temperature and the amount of water used in different washing cycles or determining the state the washing system is in. In order to acquire the desired information a considerable number of sensors, for example water meters, need to be installed in the washing system. While this is generally useful for the intended purpose, it too time and cost intensive for a broad market application due to the number of sensors that need to be installed and maintained. There is a permanent need to increase the cost efficiency of washing systems, and to reduce the maintenance effort of a washing system.

It is therefore an object of the present invention to provide an improved washing system which offers an increased cost efficiency, further it is desirable to reduce the assembling and maintenance effort of the washing system.

SUMMARY OF THE INVENTION

This object is solved by means of a system for determining an operating state of a dishwasher having the features of claim 1 and a method of determining an operating state of a dishwasher having the features of claim 4. Preferred embodiments, additional details, features, characteristics and advantages of the object of the invention of said washing system and said method are disclosed in the subclaims.

In a general aspect of the invention a washing system for determining an operating state of a dishwasher comprises a dishwasher, in particular wherein the dishwasher comprises a dishwasher interface, a dispenser unit, in particular wherein the dispenser unit comprises a dispenser interface, wherein the dispenser unit is connected to the dishwasher for dosing a detergent to the dishwasher, a logic unit, in particular wherein the logic unit is connectable to the dishwasher interface and the dispenser interface, and a current sensor for measuring an electrical current consumed by the dishwasher, wherein the current sensor is connected to the logic unit.

The dishwasher may be a mechanical or an automated cleaning device, comprising at least a washing tank for supplying water at a defined temperature to a washing zone of the dishwasher for example. The washing tank may hold a fluid, preferably water, for washing and/or rinsing. Inside the washing tank a volume of water may be heated up to a predefined washing and/or rinsing temperature for example. The washing system may be connected to a power supply, an electric mains for example, by a power supply line. Further the washing system comprises a dispenser unit connected to the dishwasher for dosing at least one washing solution, a detergent for example, to the dishwasher, in particular to the washing zone of the dishwasher. The dishwasher comprises a dishwasher interface for acquiring and providing information of the dishwasher, for example the dishwasher interface may acquire and provide values of the washing and/or rinsing temperature parameters (B, C), the washing and/or rinsing dosing parameters (D, E) and for example the machine signal (F), indicative of the washing system and/or the dishwasher being switched on. The values of the washing and/or rinsing parameters (B, C) about the temperature of water being supplied to the washing zone for example may be measured by at least one temperature sensor inside the washing tank for example. The washing and/or rinsing dosing parameters (D, E) may be indicative whether the dishwasher is supplying washing water and/or rinsing water to the washing zone. Further, the machine signal (F) may be indicative whether the washing system, in particular the dishwasher, the dispenser, the current sensor and/or the logic unit is operational. The dispenser unit may comprise a dispenser interface for acquiring and providing information in form of a dispenser dosing signal (G) whether the dispenser unit is dosing a detergent to the dishwasher or not. The dishwasher interface and the dispenser interface may be connected to a logic unit in order for the logic unit to receive the information supplied by the dishwasher interface and the dispenser interface. A current sensor may be connected to the power supply line of the dishwasher and to the logic unit in order to measure a current in the power supply line of the dishwasher, providing information about the amount of power and/or electricity consumed by the washing system, in particular the dishwasher, to the logic unit. The current sensor may measure a value of a current parameter (A), which may be indicative of the consumption of electricity of the washing system, in particular the dishwasher. The current sensor may be of an inductive type, wherein the current sensor may continuously and/or discontinuously measure the current consumed by the dishwasher. Further, the current sensor may measure only leaps in the value of the consumed current. The logic unit may comprise a micro processor and/or a memory module for storing values of parameters and/or signals and/or combinations for comparison with stored reference values/signals, wherein reference values may be defined and stored prior to operating the washing system, in order to determine the operating state of the dishwasher and/or the washing system based on the information received from the dishwasher interface, the dispenser interface and the current sensor according to a logic matrix stored in the logic unit. Further, the logic unit may monitor the provided information and define new reference values at intervals during the operating of the washing system.

The determination of the state of the dishwasher by the logic unit is based on the assumption, that the amount of water used by the dishwasher is related to the current consumed by the dishwasher. In industrial ware washing, in particular dishwashing, 90% of the power consumed by the dishwasher is consumed by the heating units for the washing and/or rinsing water. Thus, a proportional increase in energy, in particular current, consumption may be expected with an increase in washing and/or rinsing water consumption, because every increase in washing and/or rinsing water consumption causes an increase in energy consumption, due to heating the additional washing and/or rinsing water to the appropriate temperature. This may be validated by connecting an electric meter to the power supply line in order to monitor the energy consumption of the dishwasher, for example in the unit of kilowatt hour, kWh. Simultaneously the actual washing and/or rinsing water consumption, for example in litres, is determined by using a water meter. In order to obtain the kilowatt hours per litre of washing and/or rinsing water, the measured energy consumption must be divided by the required water. By using the simulation of multiple wash cycles it is possible to calculate the average current consumption in order to minimize the impact of inaccurate measurements. At last the calculated average must be multiplied by a factor of 0.9 in order to account for the energy consumption of the electrical pumps and motors, which amounts to about 10% of the supplied energy, in order to obtain the energy to heat the measured supplied washing and/or rinsing water. Thus, the amount of washing and/or rinsing water corresponding to a certain amount of energy, in particular current, consumed by the dishwasher, may be calculated according to this formula:

Water=Energy.times.0,9×_Energy ##EQU00001##

For example, according to the formula, a measured current consumption of 0.061 kWh for a given dishwasher with an average consumption of 8.17 kWh leads to a consumed amount of washing and/or rinsing water of 1119.62 litres, as can be seen in this example:

Water=8, 17 kWh.times.0, 90, 061 kWh ##EQU00002##

Water=119, 62 1 ##EQU00002.2##

Thus, the logic unit may be supplied with the required in formation in order to calculate the amount of water used by the dishwasher. This enables the logic unit, provided with the necessary input, for example from the dishwasher interface, the dispenser interface and from the current sensor, to determine the water and energy balance and to infer deviations from the standard operating state. Further, this enables the logic unit to determine an operating state of the dishwasher and/or the washing system.

The washing system according to the present invention has the advantage that the cleaning process for washing systems, in particular dishwasher, may be logged and analyzed with reduced technical efforts, by using indirect signals in combination with a logic model instead of cost intensive direct measuring of the direct data points, for example with separate water meters. The water meters which have been used so far to determine the water consumption of a dishwasher may be omitted and replaced by a current sensor connected to the power supply line of the dishwasher. By replacing costly water meters by a current sensor, the cost efficiency of the washing system may be increased. In addition, the assembling and maintenance effort of the washing system may be reduced.

In another embodiment of the invention the current sensor is designed in form of a current clamp. The current clamp allows for a fast and easy attachment to the power supply line of a dishwasher. Also, the current sensor may be retrofitted to an installed dishwasher with an online or offline management system, so that a dishwasher or washing system may be upgraded to a washing system according to the invention without disconnecting the dishwasher from the power supply.

In another preferred embodiment of the invention the logic unit is integrated in the dispenser unit, in particular in the dispenser interface. The dishwasher interface, the dispenser interface, the logic unit and/or the current sensor may be integrated in one unit and/or one housing. The current sensor and the logic unit may be implemented into an existing dispenser for solid, liquid and powder detergent, in particular without using an online management system. Integrating the logic unit into the dispenser unit has the advantage, that only one unit needs to be installed.

A further aspect of the present invention is a method of determining an operating state of a washing system, in particular of a dishwasher of a washing system, as described above, comprising the steps of measuring a value of a current parameter (A) indicative of a current consumed by the dishwasher, comparing the measured value of the current parameter (A) with a current reference value, determining the operating state of the washing system, in particular of the dishwasher, based on a result of the step of comparing.

The current sensor may be connected to the power supply line of the dishwasher and to a logic unit in order to measure the current in the power supply line of the dishwasher, enabling the measuring of a value of a current parameter (A) indicative of a current consumed by the dishwasher. The value of the current parameter (A) may be continuously or discontinuously measured. The measured value of the current parameter (A) may then be compared with a current reference value, in order to determine the operating state of the washing system, in particular the dishwasher of the washing system, based on the result of the step of comparing. The measured value of the current parameter (A) may be higher, preferably too high, lower, preferably too low, than or fit the measured and/or pre-loaded current reference value, which may be an, in particular measured, average value of the current parameter (A). The current reference value may be defined and pre-loaded prior to operating the washing system in for example a memory module of the logic unit and/or may be stored by the logic unit during and/or after an operation of the washing system based on prior washing cycles of the washing system, for example in order to account for varying environmental influences. Based on the measuring and comparing of the value of the current parameter (A) the amount of water used by the washing system, in particular the dishwasher of the washing system, may be determined, thus allowing a determining of the operating step of the washing system, in particular the dishwasher, in particular based on a logic matrix.

The determination of the state of the dishwasher by the logic unit is based on the assumption, that the amount of water used by the dishwasher is related to the current consumed by the dishwasher. In industrial ware washing, in particular dishwashing, 90% of the power consumed by the dishwasher is consumed by the heating units for the washing and/or rinsing water. Thus, a proportional increase in energy, in particular current, consumption may be expected with an increase in washing and/or rinsing water consumption, because every increase in washing and/or rinsing water consumption causes an increase in energy consumption, due to heating the additional washing and/or rinsing water to the appropriate temperature. The amount of washing and/or rinsing water corresponding to a certain amount of energy, in particular current, consumed by the dishwasher, may be calculated according to the above described formula:

Water=Energy.times.0,9×_Energy ##EQU00003##

Thus, the logic unit may deduct the amount of water used by the dishwasher, and may determine the operating state of the washing system, for example if it is in a normal washing or rinsing operation or not. The method has the advantage that the cleaning process for washing systems, in particular dishwasher, may be logged and analyzed with reduced technical efforts, by using indirect signals in combination with a logic model instead of cost intensive direct measuring of the direct data points, for example with separate water meters.

In a preferred embodiment the method further comprises the steps of measuring a value of a washing temperature parameter (B) indicative of a washing temperature of the dishwasher, comparing the measured value of the washing temperature parameter (B) with a washing temperature reference value, and determining the operating state of the washing system, in particular of the dishwasher, based on a result of the step of comparing.

In order to measure the value of a washing temperature parameter (B), a temperature sensor may, for example, be arranged in a way to measure the temperature inside for example a washing tank or a pipe supplying the heated washing water to a washing zone of the dishwasher. The value of the washing temperature parameter (B) indicative of a washing temperature of the dishwasher may be continuously or discontinuously measured. The value of the washing temperature parameter (B) may be provided from the dishwasher interface to the logic unit. The measured value of the washing temperature parameter (B) may then be compared with a washing temperature reference value, in order to determine the operating state of the washing system, in particular the dishwasher of the washing system, based on the result of the step of comparing. The measured value of the washing temperature parameter (B) may be higher, preferably too high, lower, preferably too low, than or fit the measured and/or pre-loaded washing temperature reference value, which may be an, in particular measured, average value of the washing temperature parameter (B). The washing temperature reference value may be defined and pre-loaded prior to operating the washing system in for example a memory module of the logic unit and/or may be stored by the logic unit during and/or after an operation of the washing system based on prior washing cycles of the washing system, for example in order to account for varying environmental influences. Based on the measuring and comparing of the value of the washing temperature parameter (B) the operating step of the washing system, in particular the dishwasher, may be determined, in particular based on a logic matrix.

In a particularly preferred embodiment the method further comprises the steps of measuring a value of a rinsing temperature parameter (C) indicative of a rinsing temperature of the dishwasher, comparing the measured value of the rinsing temperature parameter (C) with a rinsing temperature reference value, and determining the operating state of the washing system, in particular of the dishwasher, based on a result of the step of comparing.

In order to measure the value of a rinsing temperature parameter (C), a temperature sensor may, for example, be arranged in a way to measure the temperature inside for example a rinsing tank or a pipe supplying the heated rinsing water to a washing zone of the dishwasher. The value of the rinsing temperature parameter (C) indicative of a rinsing temperature of the dishwasher may be continuously or discontinuously measured. The value of the rinsing temperature parameter (C) may be provided from a dishwasher interface to the logic unit. The measured value of the rinsing temperature parameter (C) may then be compared with a rinsing temperature reference value, in order to determine the operating state of the washing system, in particular the dishwasher of the washing system, based on the result of the step of comparing. The measured value of the rinsing temperature parameter (C) may be higher, preferably too high, lower, preferably too low, than or fit the measured and/or pre-loaded rinsing temperature reference value, which may be an, in particular measured, average value of the rinsing temperature parameter (C). The rinsing temperature reference value may be defined and pre-loaded prior to operating the washing system in for example a memory module of the logic unit and/or may be stored by the logic unit during and/or after an operation of the washing system based on prior washing cycles of the washing system, for example in order to account for varying environmental influences. Based on the measuring and comparing of the value of the rinsing temperature parameter (C) the operating step of the washing system, in particular the dishwasher, may be determined, in particular based on a logic matrix.

In a further preferred embodiment the method further comprises the steps of detecting a washing dosing signal (D) indicative of a washing fluid being supplied, and determining the operating state of the washing system, in particular of the dishwasher, based on the detected washing dosing signal (D).

The washing dosing signal (D) indicates whether a washing fluid is supplied to the washing zone, for example, from a washing tank. The washing dosing signal (D) may be an on or off signal, for example corresponding to a washing pump operating and pumping the washing fluid or not. The washing dosing signal (D) may be provided from the dishwasher interface to the logic unit. Based on the detected washing dosing signal (D) the operating step of the washing system, in particular the dishwasher, may be determined, in particular based on a logic matrix.

In a preferred embodiment the method further comprises the steps of detecting a rinsing dosing signal (E) indicative of a rinsing fluid being supplied, and determining the operating state of the washing system, in particular of the dishwasher, based on the detected rinsing dosing signal (E).

The rinsing dosing signal (E) indicates whether a rinsing fluid is supplied to the washing zone, for example, from a rinsing tank. The rinsing dosing signal (E) may be an on or off signal, for example corresponding to a rinsing pump operating and pumping the rinsing fluid or not. The rinsing dosing signal (E) may be provided from the dishwasher interface to the logic unit. Based on the detected rinsing dosing signal (E) the operating step of the washing system, in particular the dishwasher, may be determined, in particular based on a logic matrix.

In a further preferred embodiment the method further comprises the steps of detecting a machine signal (F) indicative of a washing system being operational, and determining the operating state of the washing system, in particular of the dishwasher, based on the detected machine signal (F).

The machine signal (F) indicates whether the washing system, in particular the dishwasher, is operational or not, for example switch on. The machine signal (F) may be an on or off signal corresponding to all parts of the washing system, for example the dishwasher, the dispenser, the logic unit, being switched on and/or being operational. The machine signal (F) may be provided from the dishwasher interface, the dispenser interface and/or the logic unit to the logic unit. In case the logic unit is to provide the machine signal (F), the logic unit is designed to monitor the relevant components of the washing system. Based on the detected machine signal (F) the operating step of the washing system, in particular the dishwasher, may be determined, in particular based on a logic matrix.

In a preferred embodiment of the method the method further comprises the steps of detecting a dispenser dosing signal (G) indicative of a detergent being supplied to the dishwasher, and determining the operating state of the washing system, in particular of the dishwasher, based on the detected dispenser dosing signal (G).

The dispenser dosing signal (G) indicates whether the dispenser is dosing a detergent to the dishwasher, in particular to the washing tank of the dishwasher. The dispenser dosing signal (G) may be an on or off signal corresponding to a dosing pump being switch on or off. The dispenser dosing signal (G) may be provided from the dispenser interface to the logic unit. Based on the detected dispenser dosing signal (G) the operating step of the washing system, in particular the dishwasher, may be determined, in particular based on a logic matrix.

In a most preferred embodiment of the method the determined operating state comprises one state selected from a group comprising a high stand-by state, a normal operation state, a leaking tank state, a water volume too low state, or a temperature too high state.

The operating state of the washing system, in particular of the dishwasher, may be determined and/or indicated for example by the logic unit based on a logic model, for example a logic matrix. The logic model comprises the operating states of the washing system with the corresponding parameters and signals needed in order to determine the operating state of the washing system, in particular of the dishwasher. The parameters and signals needed to determine the operating state of the dishwasher may be made available to the logic unit. Thus, the logic unit may determine, according to the provided signals and parameters, in particularly the values of the parameters and reference values, the operating state of the washing system from a group comprising the high stand-by state, the normal operation state, the leaking tank state, the water volume too low state, or the temperature too high state.

The high stand-by state may correspond to the value of the current parameter (A), which may be measured by a current sensor, being higher or too high compared to a current reference value. The value of the current parameter (A) may be too high or too low compared to the current reference value, if the measured value of the current parameter (A) differs from the current reference value by a predefined amount. This may compensate for inaccuracies in the current measurement for example. The value of the current parameter (A) may be an indicator for the consumption of electricity of the washing system. The values of the washing and rinsing temperature parameters (B, C) essentially may fit the measured or predefined washing and/or rinsing temperature reference value, corresponding for example to an average washing and/or rinsing temperature. The washing and rinsing dosing signal (D, E) as well as the dispenser dosing signal (G) may not be detected. The machine signal (F) may be detected, as the washing system is switched on. Thus, the washing system is in the high stand-by state, for example ready for a washing operation.

The normal operation state may correspond to the value of the current parameter (A), the washing and rinsing temperature parameters (B, C) essentially fitting the measured and/or predefined current reference, washing temperature and rinsing temperature reference values, corresponding for example to an average washing and/or rinsing temperature and an average current consumed during normal operation of the washing system. The washing and rinsing dosing signal (D, E) as well as the machine signal (F) and the dispenser dosing signal (G) may be detected, indicating that with the switched on washing system a washing and rinsing fluid is dosed and that the dispenser is also dosing a detergent for example.

The leaking tank state may correspond to the value of the current parameter (A) being higher or too high compared to a current reference value. The value of the washing temperature parameter (B) may be lower or too low compared to the predefined washing temperature reference value. The value of the washing temperature parameter (B) and/or the value of the rinsing temperature value (C) may be too high or too low compared to the washing and/or rinsing temperature reference value, if the measured value of the washing and/or rinsing temperature value (B, C) differs from the washing and/or rinsing temperature reference value by a predefined amount. This may compensate for inaccuracies in the temperature measurement for example. The rinsing temperature parameters (C) may fit essentially the measured or predefined rinsing temperature reference value. The washing and rinsing dosing signal (D, E) may not be detected. The machine signal (F) and the dispenser dosing signal (G) may be detected, thus indicating a leaking washing tank, especially as the washing temperature, for example in the washing tank, is too low, indicating that the water in the washing tank is not being heated to the preset temperature, although the requires current is consumed.

The water volume too low state may correspond to the value of the current parameter (A) being lower or too low compared to a current reference value. The washing and rinsing temperature parameters (B, C) may be essentially fitting the measured and/or predefined washing temperature and rinsing temperature reference values, corresponding for example to an average washing and/or rinsing temperature during normal operation of the washing system. The washing and rinsing dosing signal (D, E) as well as the machine signal (F) may be detected, indicating that with the switched on washing system a washing and rinsing fluid is dosed. The dispenser dosing signal (G) may not be detected. The low or too low value of the current parameter may be indicative of a smaller water volume being heated up to a predefined washing temperature for example. Hence, the above combination of parameters and signals may be indicating the water too low state.

The temperature too high state may correspond to the value of the current parameter (A), the values of the washing and rinsing temperature parameters (B, C) being higher or too high compared to the current reference value and the washing and/or rinsing temperature reference value. The washing and rinsing dosing signal (D, E) as well as the machine signal (F) and the dispenser dosing signal (G) may be detected. Thus, the higher than normal value of the current parameter (A) in combination with the higher than normal values of the washing and rinsing temperature parameters (B, C) may indicate that the washing systems temperature is too high, which may be indicative of at least one defect temperature sensor.

DESCRIPTION OF THE FIGURES

Additional details, features, characteristics and advantages of the object of the invention are disclosed in the figures and the following description of the respective figures, which—in exemplary fashion—show one embodiment and an example of a washing system according to the invention. In the drawings:

FIG. 3 shows a logic matrix with the signals and parameters required for determining the operating state of the washing system.

Figure 1:
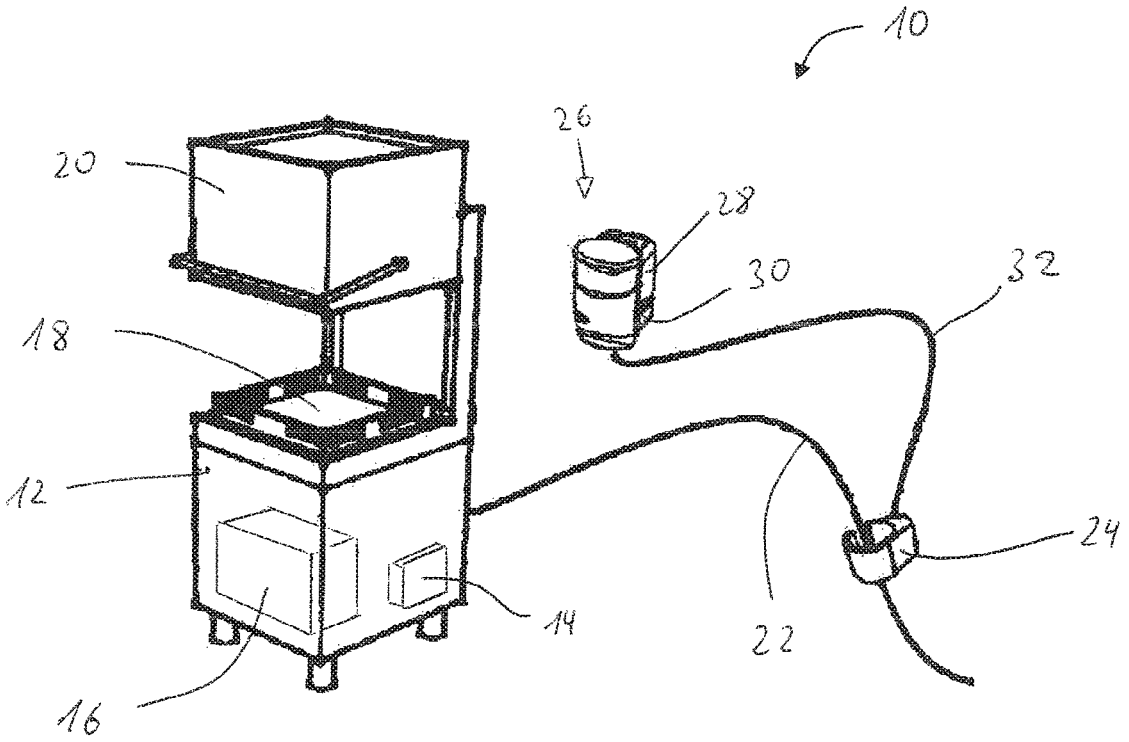
FIG. 1 shows a perspective view of a washing system according to the present invention.

The illustration in FIG. 1 shows a washing system 10 comprising a dishwasher 12 with a dishwasher interface 14, arranged inside the dishwasher 12. The dishwasher 12 comprises a washing tank 16 for supplying water to a washing zone 18 of the dishwasher 12. During a washing operation the washing zone 18 may be closed with a vertically moveable cover 20. The water inside the washing tank 16 may be heated to a desired temperature, for example according to DIN 10510, using electricity. The dishwasher is connected to electric mains by a power supply line 22. In order to measure the value of the current parameter (A), indicative of the amount of electricity consumed by the dishwasher 12, a current sensor 24 in form of a current clamp is attached to the power supply line 22 of the dishwasher 12. The current sensor 24 may be an inductive type of sensor. The current sensor 24 is connected to a dispenser unit 26 comprising a dispenser interface 28 as well as a logic unit 30, wherein the dispenser interface 28 is connected to the logic unit 30. The current sensor 24 is connected to the logic unit 30, for example through the dispenser unit 26, via a cable 32. The logic unit 30 is connected to the dishwasher interface 14 for example via a cable (not shown), wherein the logic unit 30 may receive signals and values of parameters from the dishwasher interface 14 as well as the dispenser interface 28 in order to determine the operating state of the washing system 10 based on the received signals and parameters. The dispenser unit 26 supplies a detergent to the dishwasher 12, in particular the washing tank 16 and/or the washing zone 18, via a pipe (not shown).

Figure 2:
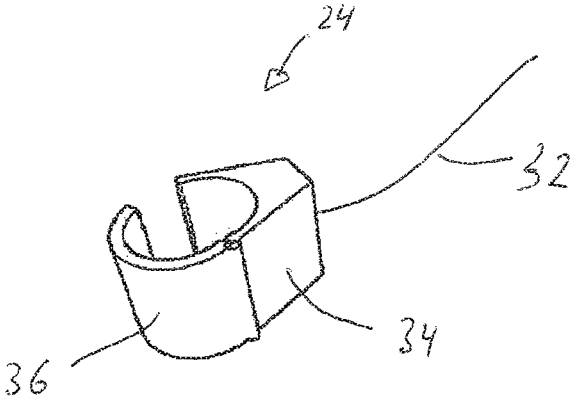
FIG. 2 shows a perspective view of a current sensor in Form of a current clamp.

In FIG. 2 the current sensor 24 in form of a current clamp is shown with the cable 32 attached. The current sensor 24 comprises a current clamp base 34 and a current clamp head 36, rotatable attached to the current clamp base 34 in order to be clamped around a power supply line 22 of the dishwasher 12 for example.

In FIG. 3 a logic matrix is shown, comprising the signals and parameters based on which the logic unit 30 may determine the operating state of the washing system 10. The logic matrix comprises a column with the current parameter (A), indicative of the consumption of electricity of the washing system 10. The current parameter (A) may be too high, higher, lower or too low compared to a current reference value. Further columns for existing default signals, for example from the dishwasher interface, are the temperature related washing and rinsing temperature parameters (B, C) and the dosing signal based washing and rinsing dosing signals (D, E). The values of the washing and rinsing temperature parameters (B, C) may be too high, higher, lower or too low compared to a washing and/or rinsing temperature reference value. The washing and rinsing dosing signals (D, E) may be either on or off, indicative of a dosing of a fluid or not. In a further column the existing default signal, the machine signal (F) is arranged. The machine signal (F) indicates whether the washing system 10 is switched on or not. The dosing signal (G) from the dispenser unit 26, in particular the dispenser interface 28, is arranged in a further column. The conclusion, the operating state of the washing system 10 related to the listed parameters and signals, is also arranged in a column.

The high stand-by state corresponds to the value of the current parameter (A) being higher or too high compared to a current reference value. The value of the current parameter (A) may be too high or too low compared to the current reference value, if the measured value of the current parameter (A) differs from the current reference value by a predefined amount. The value of the current parameter (A) may be an indicator for the consumption of electricity of the washing system. The values of the washing and rinsing temperature parameters (B, C) essentially may fit the measured or predefined washing and/or rinsing temperature reference value. The washing and rinsing dosing signal (D, E) as well as the dispenser dosing signal (G) may not be detected. The machine signal (F) may be detected.

The normal operation state corresponds to the value of the current parameter (A), the washing and rinsing temperature parameters (B, C) essentially fitting the measured and/or predefined current reference, washing temperature and rinsing temperature reference values. The washing and rinsing dosing signal (D, E) as well as the machine signal (F) and the dispenser dosing signal (G) may be detected.

The leaking tank state corresponds to the value of the current parameter (A) being higher or too high compared to a current reference value. The value of the washing temperature parameter (B) may be lower or too low compared to the predefined washing temperature reference value. The rinsing temperature parameters (C) may fit essentially the measured or predefined rinsing temperature reference value. The washing and rinsing dosing signal (D, E) may not be detected. The machine signal (F) and the dispenser dosing signal (G) may be detected, thus indicating a leaking washing tank.

The water volume too low state corresponds to the value of the current parameter (A) being lower or too low compared to a current reference value. The washing and rinsing temperature parameters (B, C) may be essentially fitting the measured and/or predefined washing temperature and rinsing temperature reference values. The washing and rinsing dosing signal (D, E) as well as the machine signal (F) may be detected. The dispenser dosing signal (G) may not be detected. The low or too low value of the current parameter may be indicative of a smaller water volume being heated up to a predefined washing temperature for example.

The temperature too high state may correspond to the value of the current parameter (A), the values of the washing and rinsing temperature parameters (B, C) being higher or too high compared to the current reference value and the washing and/or rinsing temperature reference value. The washing and rinsing dosing signal (D, E) as well as the machine signal (F) and the dispenser dosing signal (G) may be detected.

The particular combinations of elements and features in the above detailed embodiments are exemplary only; the interchanging and substitution of these teachings with other teachings in this and the patents/applications incorporate by reference are also expressly contemplated. As those skilled in the art will recognize, variations, modifications, and other implementations of what is described herein can occur to those of ordinary skill in the art without departing from the spirit and the scope of the invention as claimed. Accordingly, the foregoing description is by the way of example only and is not intending as limiting. In the claims, the wording "comprising" does not exclude other elements or steps, and the identified article "a" or "an" does not exclude a plurality.

The mere fact that certain measures are recited in mutually different dependent claims does not indicate that a combination of these measures cannot be used to advantage. The inventions scope is defined in the following claims and the equivalents thereto. Furthermore, reference signs used in the description and claims do not limit the scope of the invention as claimed.

LIST OF REFERENCE SIGNS

10 washing system
12 dishwasher
14 dishwasher interface
16 washing tank
18 washing zone
20 cover
22 power supply line
24 current sensor
26 dispenser unit
28 dispenser interface
30 logic unit
32 cable
34 current clamp base
36 current clamp head
A current parameter
B washing temperature parameter
C rinsing temperature parameter
D washing dosing signal
E rinsing dosing signal
F machine signal

What is claimed is:

1. A method of determining an operating state of a dishwasher comprising:

measuring, by a current sensor connected to each of a power supply line of the dishwasher and a processor, an electrical current consumed by the dishwasher;

sending, by the current sensor and to the processor, a first signal representative of current information indicative of the electrical current measured by the current sensor and consumed by the dishwasher;

receiving, at the processor, the first signal;

comparing, at the processor, the electrical current consumed by the dishwasher to a current reference value, the current reference value being indicative of an average current value for the dishwasher when an average volume of water is consumed by the dishwasher during an operating step of the dishwasher;

receiving, at the processor, a second signal representative of a second parameter of the dishwasher, the second parameter being different from the current information;

determining, by the processor, an operating state of the dishwasher during the operating step based on both the comparison of the received current information to the current reference value and the received second signal according to a logic matrix stored in a memory module of the processor; and logging, by the processor, the operating state of the dishwasher for user analysis.

2. The method of claim 1, wherein the determined operating state comprises one state selected from a group consisting of: a high stand-by state, a normal operation state, a leaking tank state, a water volume too low state, and a temperature too high state.

3. The method of claim 1, wherein the second signal comprises washing temperature information comprising a value of a washing temperature parameter indicative of a washing temperature of the dishwasher, the processor processes the received washing temperature information, and the processing comprises comparing the value of the washing temperature parameter with a washing temperature reference value; and the determining of the operating state of the dishwasher by the processor further comprises determining the operating state based on a result of the washing temperature comparison.

4. The method of claim 1, wherein the second signal comprises rinsing temperature information comprising a value of a rinsing temperature parameter indicative of a rinsing temperature of the dishwasher, the processor processes the received rinsing temperature information, and the processing comprises comparing the value of the rinsing temperature parameter with a rinsing temperature reference value; and the determining of the operating state of the dishwasher by the processor further comprises determining the operating state based on a result of the rinsing temperature comparison.

5. The method of claim 1, wherein the second signal comprises a washing dosing signal indicative of a washing fluid being supplied, and wherein receiving the second signal comprises receiving the washing dosing signal from a dishwasher interface, and the processor processes the received washing dosing signal; and the determining of the operating state of the dishwasher by the processor further comprises determining the operating state based on the received washing dosing signal.

6. The method of claim 1, wherein the second signal comprises a rinsing dosing signal indicative of a rinsing fluid being supplied, and wherein receiving the second signal comprises receiving the rinsing dosing signal from a dishwasher interface, and the processor processes the received rinsing dosing signal; and the determining of the operating state of the dishwasher by the processor further comprises determining the operating state based on the received rinsing dosing signal.

7. The method of claim 1, wherein the second signal comprises a machine signal indicative of the dishwasher being operational, and wherein receiving the second signal comprises receiving the machine signal from a dishwasher interface, a dispenser interface, or the processor, and the processor processes the received machine signal; and the determining of the operating state of the dishwasher by the processor further comprises determining the operating state based on the received machine signal.

8. The method of claim 1, wherein the second signal comprises a dispenser dosing signal indicative of a detergent being supplied to the dishwasher, and wherein receiving the second signal comprises receiving the dispenser dosing signal from a dispenser interface, and the processor processes the received dispenser dosing signal; and the determining of the operating state of the dishwasher by the processor further comprises determining the operating state based on the received dispenser dosing signal.

9. The method of claim 8, wherein the processor is integrated in the dispenser interface.

10. The method of claim 1, wherein the current sensor comprises a current clamp.

11. The method of claim 1, wherein the processor is integrated in a dispenser unit.

12. The method of claim 1, wherein the memory module comprises parameters and values stored by the processor during and/or after operation of the dishwasher based on prior washing cycles of the dishwasher.

13. The method of claim 1, wherein the operating step of the dishwasher comprises a washing operation.

* * * * *